US006774852B2

(12) United States Patent
Chiang et al.

(10) Patent No.: US 6,774,852 B2
(45) Date of Patent: Aug. 10, 2004

(54) FOLDING DIRECTIONAL ANTENNA

(75) Inventors: Bing Chiang, Melbourne, FL (US); William R. Palmer, Melbourne, FL (US); Griffin K. Gothard, Satellite Beach, FL (US); Christopher A. Snyder, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 10/288,256

(22) Filed: Nov. 4, 2002

(65) Prior Publication Data

US 2003/0201940 A1 Oct. 30, 2003

(Under 37 CFR 1.47)

Related U.S. Application Data

(63) Continuation-in-part of application No. 09/852,598, filed on May 10, 2001, now Pat. No. 6,476,773.

(51) Int. Cl.[7] ..... H01Q 1/38

(52) U.S. Cl. ..... 343/700 MS; 343/795; 343/846

(58) Field of Search ..... 343/700 MS, 846, 343/795, 793, 848, 872, 853, 850; H01Q 1/38

(56) References Cited

U.S. PATENT DOCUMENTS

| | | | | | |
|---|---|---|---|---|---|
| 5,173,715 | A | * | 12/1992 | Rodal et al. | 343/795 |
| 5,521,610 | A | * | 5/1996 | Rodal | 343/797 |
| 5,532,707 | A | * | 7/1996 | Klinger et al. | 343/793 |
| 6,111,549 | A | * | 8/2000 | Feller | 343/795 |

* cited by examiner

*Primary Examiner*—Hoanganh Le
(74) *Attorney, Agent, or Firm*—Hamilton, Brook, Smith & Reynolds, P.C.

(57) ABSTRACT

An antenna array formed on a deformable dielectric material or substrate includes a center element and plurality of radial elements extending from a center hub. In the operative mode, the radial elements are folded upwardly into an approximately vertical position, with the center element at the center of the hub and the radial elements circumferentially surrounding the center element. In one embodiment the center element serves an active element of the antenna array and the radial elements are controllable in a directive or reflective state to effect a directive beam pattern from the antenna array. When not in use, the antenna elements are deformed into a plane and can therefore be integrated into a housing for compact storage. In a phased array embodiment, the center element is absent and the plurality of radial elements, are controllable to steer the antenna beam.

30 Claims, 11 Drawing Sheets

FOLDING DIRECTIONAL ANTENNA

RELATED APPLICATION

This application is a continuation-in-part of a U.S. application Ser. No. 09/852,598 filed May 10, 2001now U.S. Pat. No. 6,476,773. The entire teachings of the above application are incorporated herein by reference.

FIELD OF THE INVENTION

This invention relates to mobile or portable cellular communication systems, and more particularly to a compact configurable antenna apparatus for use with mobile or portable subscriber units.

BACKGROUND OF THE INVENTION

Code division multiple access (CDMA) communication systems provide wireless communications between a base station and one or more mobile or portable subscriber units. The base station is typically a computer-controlled set of transceivers that are interconnected to a land-based public switched telephone network (PSTN). The base station further includes an antenna apparatus for sending forward link radio frequency signals to the mobile subscriber units and for receiving reverse link radio frequency signals transmitted from each mobile unit. Each mobile subscriber unit also contains an antenna apparatus for the reception of the forward link signals and for the transmission of the reverse link signals. A typical mobile subscriber unit is a digital cellular telephone handset or a personal computer coupled to a cellular modem. In such systems, multiple mobile subscriber units may transmit and receive signals on the same center frequency, but unique modulation codes distinguish the signals sent to or received from individual subscriber units.

In addition to CDMA, other wireless access techniques employed for communications between a base station and one or more portable or mobile units include those described by the Institute of Electrical and Electronics Engineers (IEEE) 802.11 standard and the industry developed wireless Bluetooth standard. All such wireless communications techniques require the use of an antenna at both the receiving and transmitting site. It is well-known by experts in the field that increasing the antenna gain in any wireless communication system has beneficial affects.

A common antenna for transmitting and receiving signals at a mobile subscriber unit is a monopole antenna (or any other antenna with an omnidirectional radiation pattern). A monopole antenna consists of a single wire or antenna element that is coupled to a transceiver within the subscriber unit. Analog or digital information for transmission from the subscriber unit is input to the transceiver where it is modulated onto a carrier signal at a frequency using a modulation code (i.e., in a CDMA system) assigned to that subscriber unit. The modulated carrier signal is transmitted from the subscriber unit antenna to the base station. Forward link signals received by the subscriber unit antenna are demodulated by the transceiver and supplied to processing circuitry within the subscriber unit.

The signal transmitted from a monopole antenna is omnidirectional in nature. That is, the signal is sent with approximately the same signal strength in all directions in a generally horizontal plane. Reception of a signal with a monopole antenna element is likewise omnidirectional. A monopole antenna does not differentiate in its ability to detect a signal in one azimuth direction versus detection of the same or a different signal coming from another azimuth direction. Also, a monopole antenna does not produce significant radiation in the elevation direction. The antenna pattern is commonly referred to as a donut shape with the antenna element located at the center of the donut hole.

A second type of antenna employed by mobile subscriber units is described in U.S. Pat. No. 5,617,102. The directional antenna comprises two elements which are mounted on the outer case of a laptop computer, for example. A phase shifter attached to each element imparts a phase angle delay to the input signal, thereby modifying the antenna pattern (which applies to both the receive and transmit modes) to provide a concentrated signal or beam in the selected direction. Concentrating the beam increases the antenna gain and directivity. The dual element antenna of the cited patent thereby directs the transmitted signal into predetermined sectors or directions to accommodate for changes in orientation of the subscriber unit relative to the base station, thereby minimizing signal loss due to the orientation change. In accordance with the antenna reciprocity theorem, the antenna receive characteristics are similarly effected by the use of the phase shifters.

CDMA cellular systems are interference limited systems. That is, as more mobile or portable subscriber units become active in a cell and in adjacent cells, frequency interference increases and thus bit error rates also increase. To maintain signal and system integrity in the face of increasing error rates, the system operator decreases the maximum data rate available to one or more users, or decreases the number of active subscriber units, which thereby clears the airwaves of potential interference. For instance, to increase the maximum available data rate by a factor of two, the number of active mobile subscriber units is halved. However, this technique cannot generally be employed to increase data rates due to the lack of service priority assignments to the subscribers. Finally, it is also possible to avert excessive interference by using directive antennas at both (or either) the base station and the portable units. Typically, a directive antenna beam pattern is achieved through the use of a phased array antenna. The phased array is electronically scanned or steered to the desired direction by controlling the phase angle of the signal input to each antenna element. However, phased array antennas suffer decreased efficiency and gain as the element spacing becomes electrically small compared to the wavelength of the received or transmitted signal. When such an antenna is used in conjunction with a portable or mobile subscriber unit, generally the antenna array spacing is relatively small and thus antenna performance is correspondingly compromised.

In a communication system in which portable or mobile units communicate with a base station, such as a CDMA communication system, the portable or mobile unit is typically a hand-held device or a relatively small device, such as, for instance, the size of a laptop computer. In some embodiments, the antenna is inside or protrudes from the device housing or enclosure. For example, cellular telephone handsets utilize either an internal patch antenna or a protruding monopole or dipole antenna. A larger portable device, such as a laptop computer, may have the antenna or antenna array mounted in a separate enclosure or integrated into the laptop case. A separate antenna may be cumbersome for the user to manage as the communications device is carried from one location to another. While integrated antennas overcome this disadvantage, they are generally in the form of protrusions from the communications device, except for a patch antenna. These protrusions can be broken or damaged as the device is moved from one location to another. Even minor damage to a protruding antenna can drastically change it's operating characteristics.

SUMMARY OF THE INVENTION

Problems of the Prior Art

Several considerations must be taken into account in integrating a wireless-network antenna into an enclosure, whether the enclosure comprises a unit separate from the communications device or the housing of the communications device itself. In designing the antenna and its associated enclosure, careful consideration must be given to the antenna electrical characteristics so that signals transmitted from and received by the communications device satisfy pre-determined operational limits, such as the bit error rate, signal-to-noise ratio or signal-to-noise-plus-interference ratio. The electrical properties of the antenna, as influenced by the antenna physical parameters, are discussed further herein below.

The antenna must also exhibit certain mechanical characteristics to achieve user needs and meet the required electrical performance. The antenna length, or the length of each element of an antenna array, depends on the received and transmitted signal frequencies. If the antenna is configured as a monopole, the length is typically a quarter wavelength of the signal frequency. For operation at 800 MHz (one of the wireless frequency bands) a quarter wavelength monopole is 3.7 inches long. If the antenna is a half-wave dipole, the length is 7.4 inches.

The antenna must further present an aesthetically pleasing appearance to the user. If the antenna is deployable from the communications device, sufficient volume within the communications device must be allocated to the stored antenna and its peripheral components. But since the communications device is used in mobile or portable service, the device must remain relatively small and light with a shape that allows it to be easily carried. The antenna deployment mechanism must be mechanically simple and reliable. For those antennas housed in an enclosure separate from the communications device, the connection mechanism between the antenna and the communications device must be reliable and simple.

Not only are the electrical, mechanical and aesthetic properties of the antenna important, but it must also overcome unique performance problems in the wireless environment. One such problem is called multipath fading. In multipath fading, a radio frequency signal transmitted from a sender (either a base station or mobile subscriber unit) may encounter interference in route to the intended receiver. The signal may, for example, be reflected from objects, such as buildings, thereby directing a reflected version of the original signal to the receiver. In such instances, the receiver receives two versions of the same radio frequency (RF) signal: the original version and a reflected version. Each received signal is at the same frequency, but the reflected signal may be out of phase with the original due to the reflection and consequent differential transmission path length to the receiver. As a result, the original and reflected signals may partially or completely cancel each other out (destructive interference), resulting in fading or dropouts in the received signal.

Single element antennas are highly susceptible to multipath fading. A single element antenna cannot determine the direction from which a transmitted signal is sent and therefore cannot be tuned to more accurately detect and receive a transmitted signal. Its directional pattern is fixed by the physical structure of the antenna components. Only the antenna position and orientation can be changed in an effort to obviate the multipath fading effects.

The dual element antenna described in the aforementioned patent reference is also susceptible to multipath fading due to the symmetrical and opposing nature of the hemispherical lobes of the antenna pattern. Since the antenna pattern lobes are more or less symmetrical and opposite from one another, a signal reflected to the back side of the antenna can have the same received power as a signal received at the front. That is, if the transmitted signal reflects from an object beyond or behind the received antenna and is then reflected back to the intended receiver from the opposite direction as the signal received directly from the source, then a phase difference in the two signals creates destructive interference due to multipath fading.

Another problem present in cellular communication systems is inter-cell signal interference. Most cellular systems are divided into individual cells, with each cell having a base station located at its center. The placement of each base station is arranged such that neighboring base stations are located at approximately sixty degree intervals from each other. Each cell may be viewed as a six sided polygon with a base station at the center. The edges of each cell adjoin and a group of cells form a honeycomb-like pattern. The distance from the edge of a cell to its base station is typically driven by the minimum power required to transmit an acceptable signal from a mobile subscriber unit located near the edge of the cell to that cell's base station (i.e., the power required to transmit an acceptable signal a distance equal to the radius of one cell).

Intercell interference occurs when a mobile subscriber unit near the edge of one cell transmits a signal that crosses over the edge into a neighboring cell and interferes with communications taking place within the neighboring cell. Typically, signals in neighboring cells on the same or closely-spaced frequencies cause intercell interference. The problem of intercell interference is compounded by the fact that subscriber units near the edge of a cell typically transmit at higher power levels so that their transmitted signal can be effectively received by the intended base station located at the cell center. Also, the signal from another mobile subscriber unit located beyond or behind the intended receiver may arrive at the base station at the same power level, representing additional interference.

The intercell interference problem is exacerbated in CDMA systems since the subscriber units in adjacent cells typically transmit on the same carrier or center frequency. For example, two subscriber units in adjacent cells operating on the same carrier frequency but transmitting to different base stations interfere with each other if both signals are received at one of the base stations. One signal appears as noise relative to the other. The degree of interference and the receiver's ability to detect and demodulate the intended signal is also influenced by the power level at which the subscriber units are operating. If one of the subscriber units is situated at the edge of a cell, it transmits at a higher power level, relative to other units within its cell and the adjacent cell, to reach the intended base station. But, its signal is also received by the unintended base station, i.e., the base station in the adjacent cell. Depending on the relative power level of two same-carrier frequency signals received at the base station, it may not be able to properly differentiate a signal transmitted from within its cell from a signal transmitted from the adjacent cell. A mechanism is required to reduce the subscriber unit antenna's apparent field of view, which can have a marked effect on the operation of the forward link (base to subscriber) by reducing the apparent number of interfering transmissions received at a base station. A similar mechanism is needed for the forward link, to improve the received signal quality at the subscriber unit.

In summary, in wireless communications technology, it is of utmost importance to maximize antenna performance while minimizing size and manufacturing complexity. The present invention addresses these needs.

Brief Description of the Present Invention

An integral low profile directional antenna comprises a plurality of elongated antenna arms extending radially from an integral center hub wherein the antenna arms are deformably foldable upwardly into a substantially perpendicular orientation from the center hub to form a directional antenna array. The antenna further comprises a center arm extending from the integral center hub. For storage and transportation, the low profile directional antenna is compactly retractable by deforming the elongated arms into the plane of the integral center hub. The antenna arms and the integral center hub are formed from a homogeneous deformable material, by die cutting, for example, thereby avoiding the need for a separate hinged or pivotal joint for attaching the antenna arms to the integral center hub. The homogeneous deformable material simplifies manufacturing of the antenna and installation into the antenna enclosure.

In one embodiment, the low profile directional antenna includes five elongated arms and a center arm, all of which are cut from a single sheet of deformable material. Each of these six elements is deformable from an orientation where all elements are in a single plane, into an active or deployed configuration where each element is bent upwardly to form an approximately 90 degree angle with the center hub. Fabricating the antenna from a single sheet avoids all gluing, soldering, etc. operations that are otherwise required to connect the various elements to form the antenna. Also, there are no joints to be created since a deformable material is used. Conductive traces, ground planes, radiating structures, vias, etc. are disposed on the deformable material or on parallel layers bonded above or below the deformable material. These conductive components are produced on the deformable material by an etching or printing process. The fabrication parts count is low (there is only one piece part) and thus labor costs are minimized through fabrication of all the antenna elements from the single part.

Further, the deformable material can include conductive traces disposed thereon for interconnecting microelectronic elements mounted onto homogeneous material surface. An external interface connects the microelectronic elements to a power source and to the communications device. By forming the electronic antenna elements on the deformable, homogeneous surface, a large electrical aperture is formed when the antenna is deployed, yet the antenna presents a low profile, compact package in the closed or stowed configuration.

BRIEF DESCRIPTION OF THE DRAWINGS

The foregoing and other features and advantages of the invention will be apparent from the following more particular description of the preferred embodiments of the invention, as illustrated in the accompanying drawings in which like referenced characters refer to the same parts throughout the different figures. The drawings are not necessarily to scale, emphasis instead being placed upon illustrating the principles of the invention.

DETAILED DESCRIPTION OF THE PREFERRED EMBODIMENTS

Figure 1:
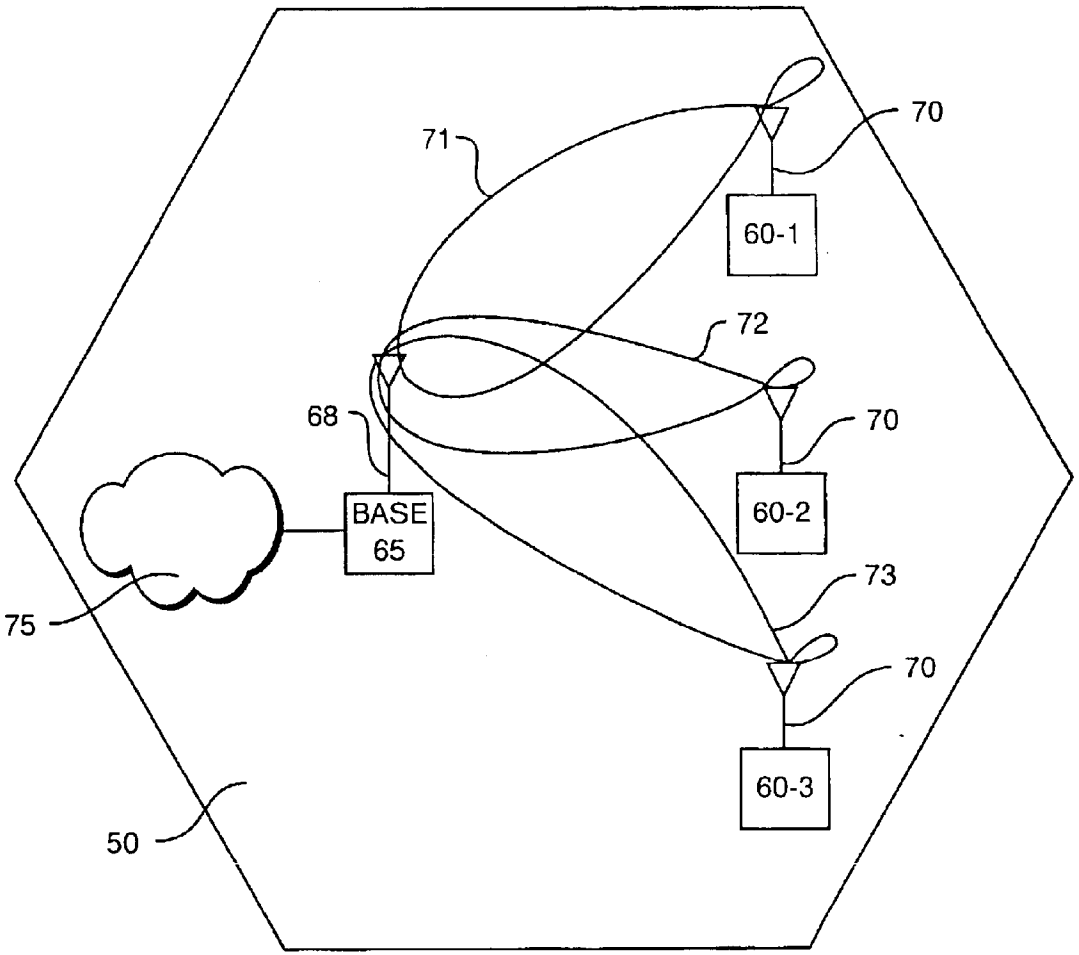
FIG. 1 illustrates a typical communications cell.

FIG. 1 illustrates one cell 50 of a typical CDMA cellular communication system. The cell 50 represents a geographical area in which mobile subscriber units 60-1 through 60-3 communicate with a base station 65. Each subscriber unit 60 is equipped with an antenna 70, which may be constructed according to the present invention. The subscriber units 60 are provided with wireless data and/or voice services by the system operator, through which devices such as, for example, laptop computers, portable computers, personal digital assistants (PDAs) or the like can be connected to the base station 65 (including the antenna 68) to a network 75, which can be the public switched telephone network (PSTN), a packet switched computer network (such as the Internet) a public data network or a private network. The base station 65 communicates with the network 75 over any number of different available communications protocols such as primary rate ISDN, or other LAPD based protocols such as IS-634 or V5.2, or TCP/IP if the network 75 is a packet based Ethernet network such as the Internet. The subscriber units 60 may be mobile in nature and may travel from one location to another while communicating with the base station 65. As the subscriber units leave one cell and enter another, the communications link is handed off from the base station of the exiting cell to the base station of the entering cell.

FIG. 1 illustrates one base station 65 and three mobile subscriber units 60 in a cell 50 by way of example only and for ease of description of the invention. The invention is applicable to systems in which there are typically many more subscriber units communicating with one or more base stations in an individual cell, such as the cell 50. The invention is further applicable to any wireless communication device or system.

It is also to be understood by those skilled in the art that FIG. 1 may be a standard cellular type communications system employing signaling schemes such as a CDMA, TDMA, GSM or others in which the radio frequency channels are assigned to carry data and/or voice between the base stations 65 and subscriber units 60. In a preferred embodiment, FIG. 1 is a CDMA-like system, using code division multiplexing principles such as those defined in the IS-95B standards for the air interface.

In one embodiment of the cell-based system, the mobile subscriber units 60 employ an antenna 70 that provides directional reception of forward link radio signals transmitted from the base station 65, as well as directional transmission of reverse link signals (via a process called beam forming) transmitted from the mobile subscriber units 60 to the base station 65. This concept is illustrated in FIG. 1 by the example beam patterns 71 through 73 that extend outwardly from each mobile subscriber unit 60 more or less in a direction for best propagation toward the base station 65. By directing transmission more or less toward the base station 65, and directively receiving signals originating from the base station 65, the antenna apparatus 70 reduces the effects of intercell interference and multipath fading for the mobile subscriber units 60. Moreover, since the antenna beam patterns 71, 72 and 73 extend outwardly in the direction of the base station 65, but are attenuated in most other directions, less power is required for transmission of effective communications signals from the mobile subscriber unit 60 to the base station 65.

Figure 2:
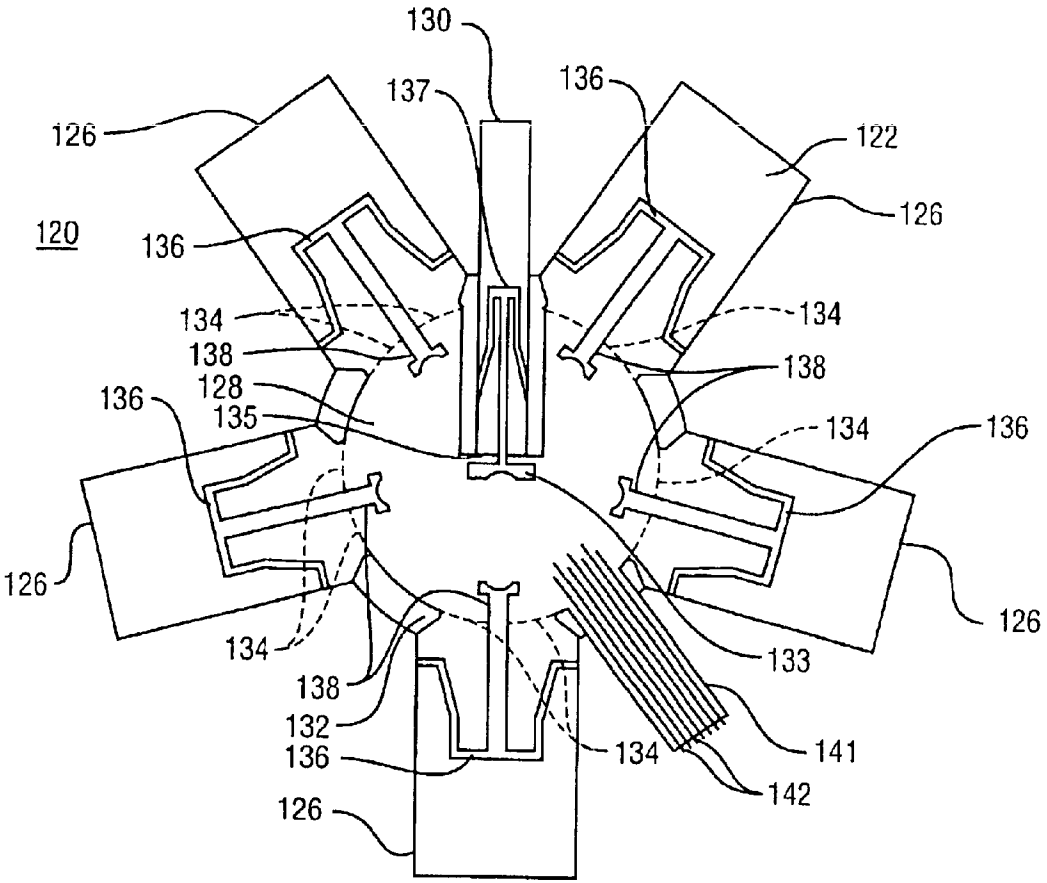

FIG. 2 illustrates an antenna array 120 formed on and fabricated from a single dielectric substrate of flexible or deformable material 122. The components of the antenna array 120, to be discussed further hereinbelow, are formed by cutting or stamping a blank sheet of the dielectric substrate material in the pattern of FIG. 2. Cutting the dielectric material forms a plurality of radial wings 126 (five radial wings as shown in FIG. 2 are merely exemplary) and a center element 130. In another embodiment wherein the antenna array 120 operates as a phased array, the center element 130 is not present. Each of the radial wings 126 and the center element 130 extend from a center hub 128. As shown, the radial wings 126 extend from the circumference of the center hub 128 and the center element 130 extends from approximately the center of the center hub 128. When the radial wings 126 and the center element 130 are fabricated from the dielectric sheet, a gap in the dielectric substrate 122 is formed between adjacent radial wings, and a gap is formed on each side of the center element 130. In FIG. 2, a ground plane 132 is located below the dielectric substrate 122. Since in the exemplary embodiment of FIG. 2 the ground plane 132 has a diameter slightly larger than the diameter of the center hub 128, the ground plane 132 is visible through the gaps.

In FIG. 2, the radial wings 126, the center element 130 and the center hub 128 are illustrated in a stored or flat configuration. That is, the radial wings 126, the center element 130 and the center hub 128 are in the same plane. In the operational mode, each of the radial wings 126 is deformed upwardly with respect to the center hub 128 along a fold line 134 in the deformable material of the dielectric substrate 122. The center element 130 is similarly deformed upwardly along a fold line 135. In one embodiment the fold lines 134 and 135 merely represent the line along which the respective element is folded due to the deformable property of the dielectric substrate 122. In another embodiment, the fold line represents a perforation line or zipper holes included to enhance the foldability or flexural properties (i.e., allowing deformation of the joint without exceeding the stress limits of the joint) of the antenna elements.

Conductive elements 136 are formed on each of the radial wings 126. A conductive element 137 is formed on the center element 130. In one embodiment the interacting elements are formed on both the front and back surfaces of the radial wings 126 and the center element 130. As will be discussed herein below, in one embodiment the conductive element 137 is an active element for sending or receiving a signal, and the conductive elements 136 are configured as either reflective elements or directive elements with respect to the received or transmitted signal. The shape of the conductive elements 136 and 137 as shown in FIG. 2 is merely exemplary. In another embodiment, the conductive elements 136 are monopole antennas, which are selectably coupled to or decoupled from the ground plane 132 to effectuate the directive and reflective properties. A switch not shown in FIG. 2 controls this connectivity between the conductive elements 136 and the ground plane 132. The switch can be implemented with a junction diode, a MOSFET, a bipolar junction transistor or a MEMS (microelectronics machine structure) switch.

The antenna of FIG. 2 is enclosed within a housing for use in conjunction with a communications device. Thus, the shape and dimensions of an operative antenna and its constituent elements depend on the desired antenna performance characteristics (e.g., operational frequency, input impedance, gain, bandwidth) and the dimensions and shape of the preferred housing. Additionally, if the housing dimensions dictate a certain maximum conductive element dimension, an element width, for example, then it may be necessary to increase another conductive element dimension to compensate for the restraint on the other dimension. Not only are the dimensions of the conductive elements affected by these parameters, but the actual shape employed must also take these factors into consideration.

Note in the FIG. 2 embodiment, that a segment 138 of the conductive elements 136 may extend onto the center hub 128 and thus is intersected by the center hub circumference and the fold line 138. Similarly, a segment 139 of the conductive element 137 extend beyond the fold line 135 onto the center hub 128. The segments 138 and 139 are flexible or deformable to avoid breaking or splintering of the conductive material when the conductive elements 136 and 137 are folded or deformed. The segments 138 and 139 are connected to vias (not shown in FIG. 2) within the center hub 128. These vias contact conductive traces (not shown in FIG. 2) running along the lower or upper surface or in a buried layer of the center hub 128. Certain traces requiring connection to an external device terminate in an interface 141. The conductive traces and vias carry power, control and RF signals for the elements of the antenna array 120 and also interconnect electronics components (not shown in FIG. 2) mounted on the top or bottom surface of the center hub 128, on one or more of the radial wings 126 or on the center element 130. The interface 141 connects to external components (via a connector not shown) for supplying electrical power, control signals, the transmitted signal in the transmit mode and the received signal in the receive mode. Further, the switches for providing the connectivity to the ground plane 132 as discussed above, constitute such electronics components.

The conductive elements 136 and 137 are formed of a conductive material and disposed on the dielectric substrate 122 by printing or etching. In one embodiment the dielectric substrate 122 comprises mylar or Kapton with a copper surface disposed thereon. The conductive elements 136 and 137 comprise copper patterns formed by etching the copper from the mylar or Kapton substrate. Alternatively, conductive ink or epoxy can be used to print the conductive elements 136 and 137 on a dielectric substrate.

Figure 3:
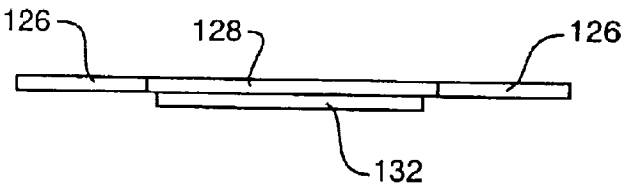
FIGS. 2, 3 and 4 illustrate views of an antenna embodiment constructed according to the teachings of the present invention.

FIG. 3 is a side view of the antenna array 120, showing in particular two radial wings 126 and the center hub 128. The ground plane 132 is also visible. Note that in this embodiment the ground plane 132 extends beyond the circumference of the center hub 128. Such is not a requirement of the present invention.

Figure 4:
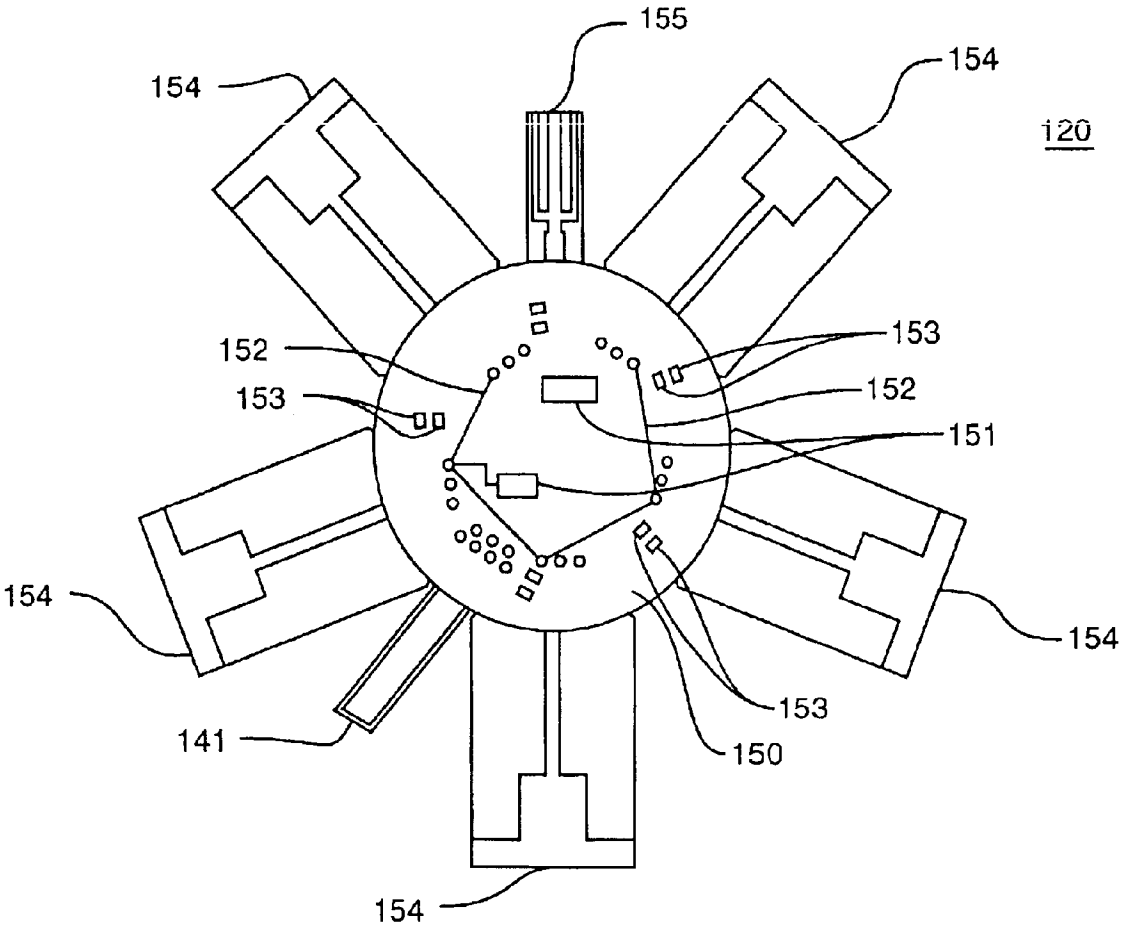

FIG. 4 is a bottom view of the antenna array 120, and in this embodiment there is included a substrate 150 patterned for accepting electronics components 151 for operation in conjunction with the conductive elements 136 and 137. Traces 152 and vias 153, for interconnecting the conductive elements 136 and 137, the electronics components 151 and the interface 141, as shown on the bottom surface of the substrate 150, are merely examples.

FIG. 4 also depicts conductive elements 154 on the rear surface of each radial wing 126. A conductive element 155 is disposed on the rear surface of the center element 130. Neither the conductive elements 154 and 155 are required in certain embodiments. The conductive elements 154 operate in cooperation with the conductive elements 136 (either conductively or inductively coupled thereto) to serve either a reflective or directive function with respect to the received or transmitted signal. For example, in one embodiment the conductive elements 154 form a transmission line for feeding the conductive elements 136, e.g., a sleeve dipole antenna. Similarly, the conductive element 155 operates in conjunction with the conductive element 137 (both located on the center element 130). Recall that the center element 130 serves as an active element of the antenna array 120, but is unnecessary when the antenna array operates in a phased array mode, wherein the phase of the input signal to each of the conductive elements 136/154 is controllable to steer the antenna beam.

Figure 5:
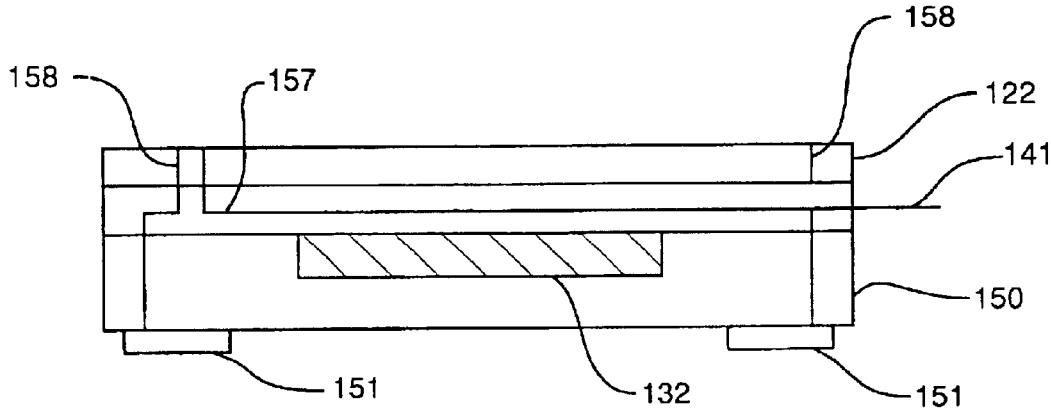
FIGS. 5, 6 and 7 illustrate cross sectional views of the embodiments of the antennas of FIGS. 2, 3 and 4.

FIG. 5 is a side view of the various layers discussed in conjunction with FIGS. 2, 3 and 4. The layers are shown in exaggerated form for clarity. The ground plane 132 is positioned below the dielectric substrate 122, and the substrate 150 is oriented below and surrounding the ground plane 132. Note that the ground plane 132 extends slightly beyond the circumference of the center hub 128. FIG. 5 also illustrates exemplary traces 157 and vias 158 in the dielectric substrate 122 and the substrate 150 for providing electrical connectivity among the conductive elements 136, 137, 154 and 155, the electronics components 151 and the interface 141. It is also recognized that some form of insulation must be provided between the traces 157 and the ground 132 and further that additional traces not in the plane of FIG. 5 are disposed on the dielectric substrate 122. The traces 157 are typically constructed from the flex-circuit conductive material consistent with the deformable characteristics of the dielectric substrate.

Figure 6:
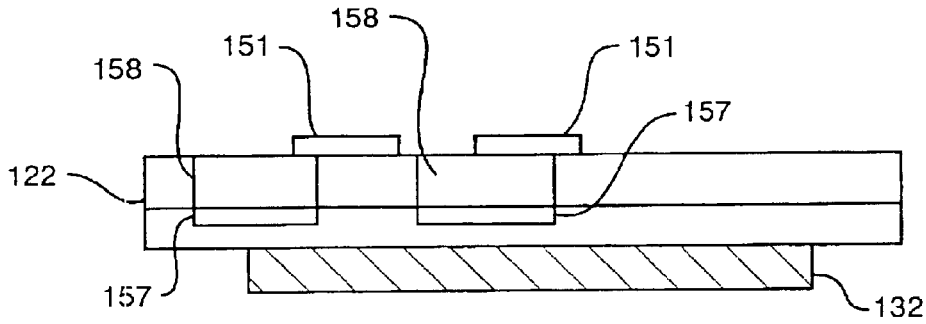

FIG. 6 illustrates another embodiment excluding the substrate 150. In this embodiment, the microelectronics component 151 are mounted on the dielectric substrate 122 preferably within the center hub 128. The traces 157 and the vias 158 provide a conductive path from the segments 138 and 139 of the conductive elements 136 and 137, respectively, to the various microelectronic components 151 and are also in conductive communication with the conductive elements 154 and 155. (See FIG. 4). In another embodiment, the traces 157 are disposed on the top surface of the dielectric substrate 122 or on both the top and bottom surfaces thereof. Generally, with respect to all of the embodiments described herein, the copper surfaces are encapsulated with a protective dielectric material to seal the surfaces against exposure to the elements. Techniques for accomplishing this are well known in the art.

Figure 7:
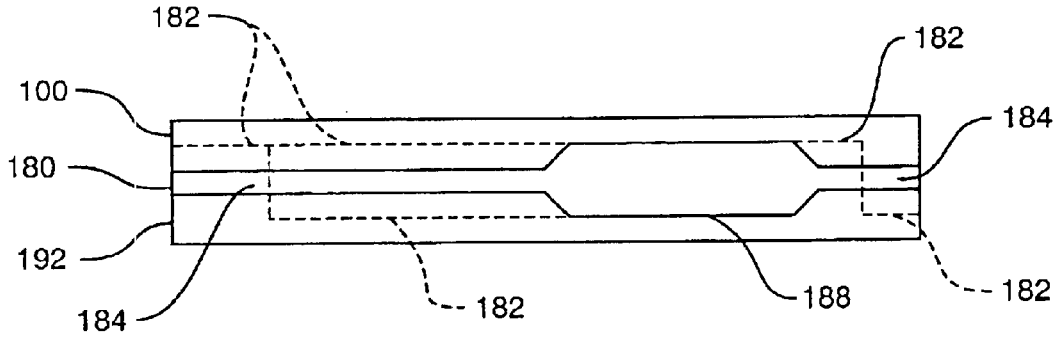

FIG. 7 illustrates an additional embodiment for forming the various parallel layers of the antenna array 120. In particular, a dielectric substrate 180 is formed with flexible conductive traces 182 (referred to as flex circuit) on both top and bottom surfaces thereof. Vias 184 connect the conductive traces 182 as required to carry signals to and from the antenna array 120 via the interface 141 and further between the microelectronic components 151 and the conductive elements 136, 137, 154 and 155. In a region 188 the dielectric substrate 180 is thickened. This thickened region can coincide with the location of the radial wings 126 and the center element 130 to provide the deformable joint with greater durability. A dielectric substrate 190 is situated above the dielectric substrate 180 and a dielectric substrate 192 is situated below the dielectric substrate 180. The dielectric substrates 190 and 192 are also formed of rigid or deformable material. However, if the dielectric substrates 190 and 192 are located so as to not interfere with the fold lines 135 and 138 (see FIG. 2) then the dielectric substrates 190 and 192 can be formed of a rigid material. Although not shown in FIG. 7, a ground plane can be disposed below the dielectric substrate 192.

Instead of creating the radial wings 126 and the center element 130 from a single dielectric sheet, as discussed above, in another embodiment of the present invention the antenna elements are separately formed and joined. In one embodiment, the radial wings 126 and the center element 130 are formed from a flexural or deformable material and joined to the center hub 128 by an adhesive joint. Alternatively, the radial wings 126 and the center element 130 can be joined to the center hub 128 by first forming solderable vias in each of the mating elements. The two piece parts are brought into contact with each other and then the vias soldered to create a junction therebetween. Since in this embodiment the radial wings 126 and the center element 130 are formed from a deformable material, the radial wings 126 and the center element 130 can be deformed along the fold lines 135 and 138, as indicated in FIG. 2. Alternatively, either or both of the radial wings 126 (and the center element 130) and the center hub 128 can be formed of a rigid material and joined by interposing a piece of deformable or pivotable material therebetween. The fold lines 135 and 138 are therefore formed in the joining material. For example, the radial wings 122 and the center element 130 can be formed from a rigid dielectric material, and joined to the center hub 128 with a piece of deformable material affixed to each radial wing 126 and to the center hub 128 (by gluing, for example). The center element 130 is similarly affixed to the center hub 128. In this embodiment, the center hub 128 can be constructed from a rigid material, printed circuit board material, for example, or from a flexible or deformable material. As an alternative to using an adhesive to join the radial wings 126 and the center element 130 to the center hub 128, solderable vias can be disposed on each of the two mating flexible surfaces. The two piece parts are mated and the vias soldered to create a deformable junction between the two pieces.

In one embodiment of the present invention the conductive elements 136, 137, 154 and 155 are disposed on opposite sides of the dielectric substrate 122 (by printing or etching, for example). A second layer of deformable material (typically the same material used to form the dielectric substrate 122) is then laminated over both the bottom and top surfaces of the dielectric substrate 122 to form a multilayer substrate with the various conductive elements disposed between the dielectric layers, thereby protecting the conductive surfaces.

In one operational mode, the conductive center element 137 (in conjunction with conductive element 155) transmits and receives radio frequency signals, while the conductive elements 136 (operating in conjunction with the conductive elements 154) serve either as reflectors or directors. The effective length of each of the conductive elements 136 is controllable to achieve a reflective mode by making the effective length longer than the resonant length so that energy incident on the conductive element 136 is reflected back toward the source. In a directive mode (when the effective length is less than the resonant length) the conductive element 136 is essentially invisible to the radio frequency signal. In this way, the radiating pattern from the active element 132 can be steered or directed to a specific sector of a 360 degree azimuth circle. In another operative embodiment, the conductive elements 136 and 154 on each of the radial wings 126 operate as a phased array wherein the phase angle of the signal input to each antenna element is controllable to steer the antenna beam. The center element 130 is absent in the phased array mode The antenna array 120 constructed according to the teachings of the present invention is relatively easy to manufacture using low-cost components and few assembly steps. The reduced number of processing operations during assembly results in higher repeatability and product yields, and lower cost. The use of a single sheet of a deformable dielectric substrate for the antenna elements avoids the formation of separate mechanical joints, and provides a compact stored configuration and a fully functional operable configuration by simply folding the center element 130 and the radial wings 126 into their operative vertical positions.

Figure 8:
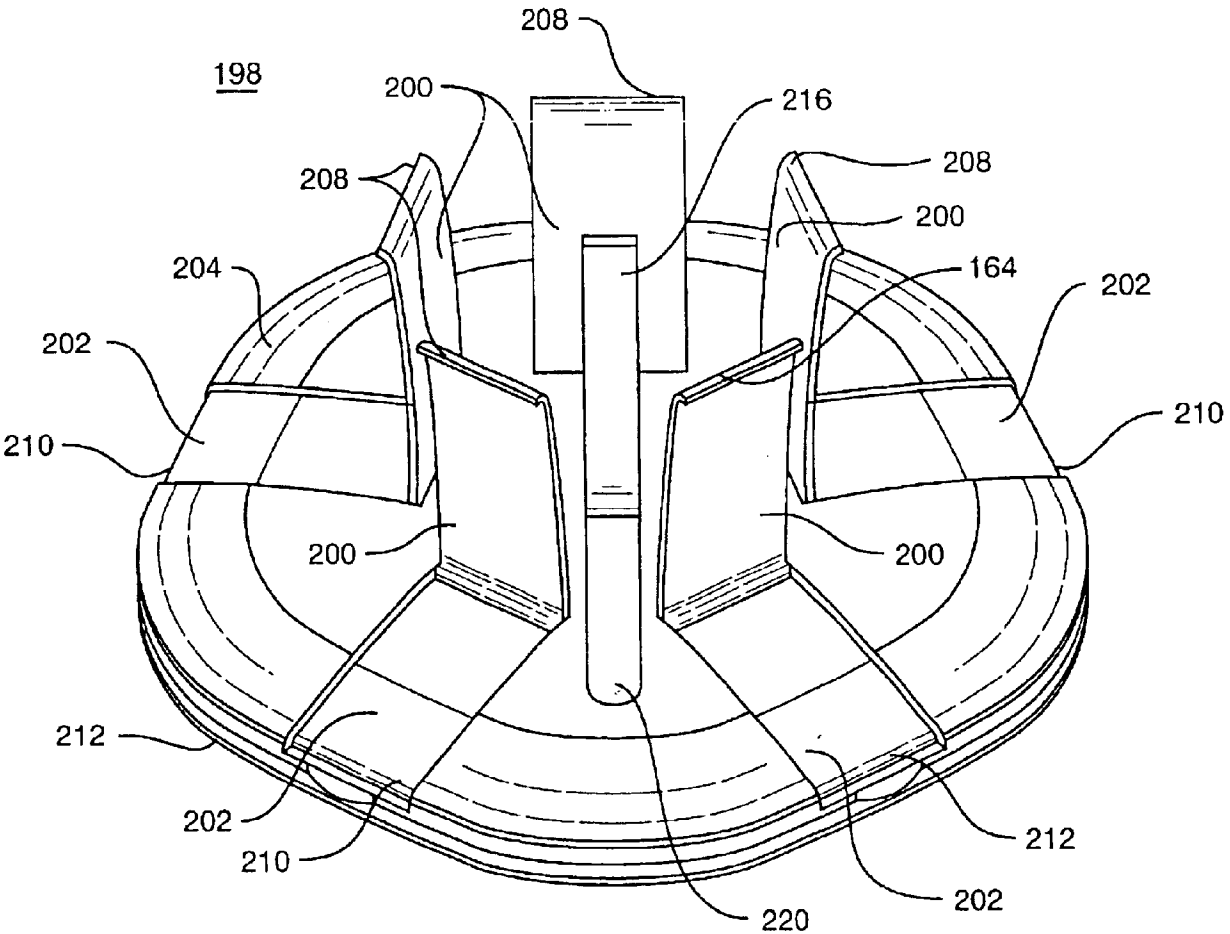
FIGS. 8, 9 and 10 depict antenna enclosures constructed according to the teachings of the present invention where the antenna elements are illustrated in both deployed and stored configurations.

One exemplary housing 198 for packaging the antenna array 120 is illustrated in FIG. 8 where the individual radial elements 126 and the center element 128 are encased within a plastic or dielectric frame 200 that mates with respective recesses 202 in a base 204. As is known to those skilled in the art, there are several plastic materials suitable for forming the housing 198, for example, Lexan, polypropylene, polycarbonate and ABS plastic. Each of the dielectric frames 200 enclosing a radial wing 126 further comprises a lip 208 for mating with respective recesses 210 formed in the edge 212 of the base 204. The center element 127 is enclosed within a dielectric frame 216. The dielectric frame 216 mates with a recess 220 within the base 204. For optimum operation of the antenna array 120, the radial wings 126 and the center element 130 must be folded or rotated upwardly to form a predetermined angle with the base 204. In one embodiment, this angle is 90 degrees. To ensure the radial wings 126 and the center element 130 are placed into the optimum angle, a stop position is built into the housing 198. The stop position is controlled by the mating or abutting surfaces between the dielectric frames 200 and 216 and the base 204 when in the operational mode.

Figure 9:
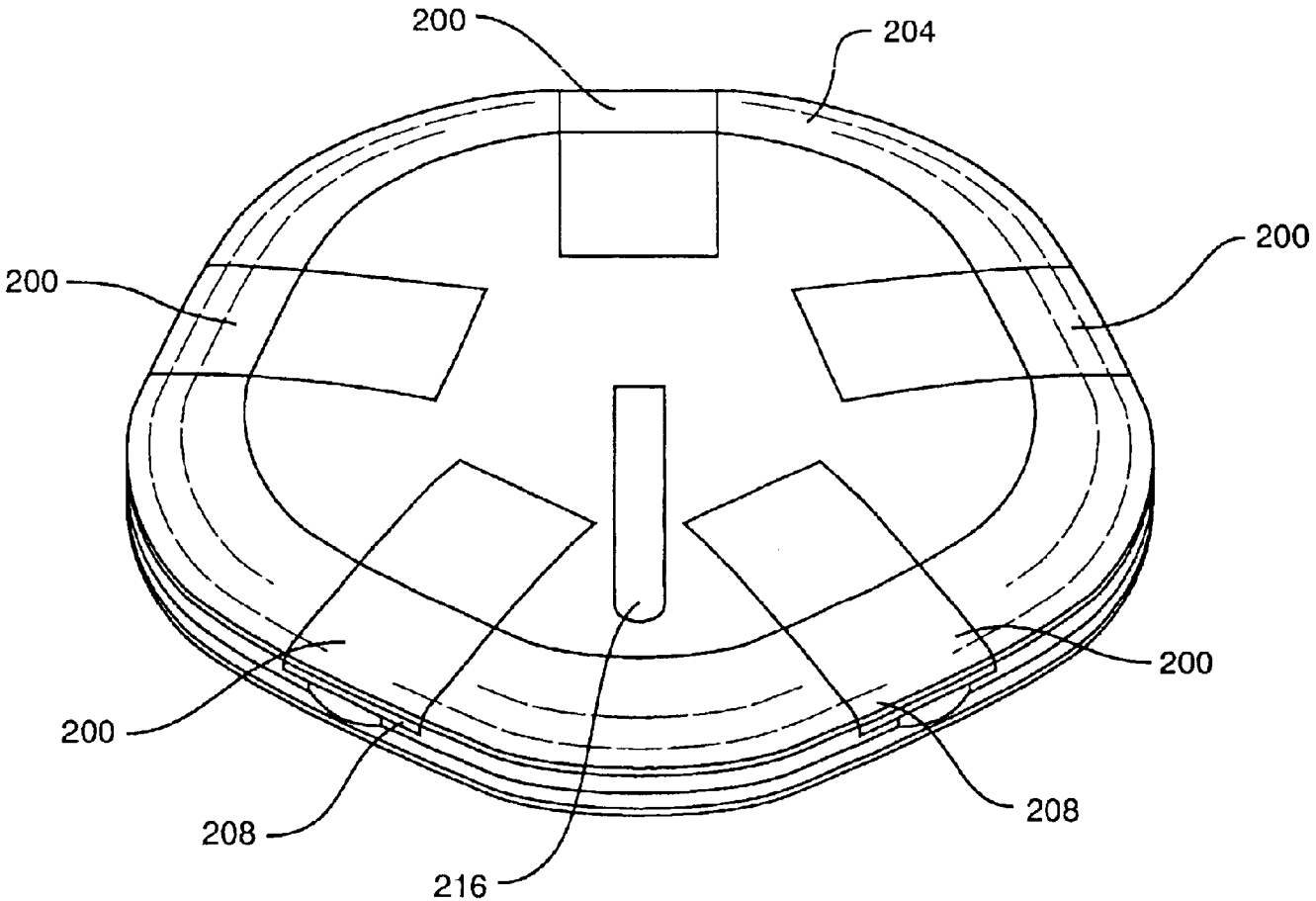
Figure 10:
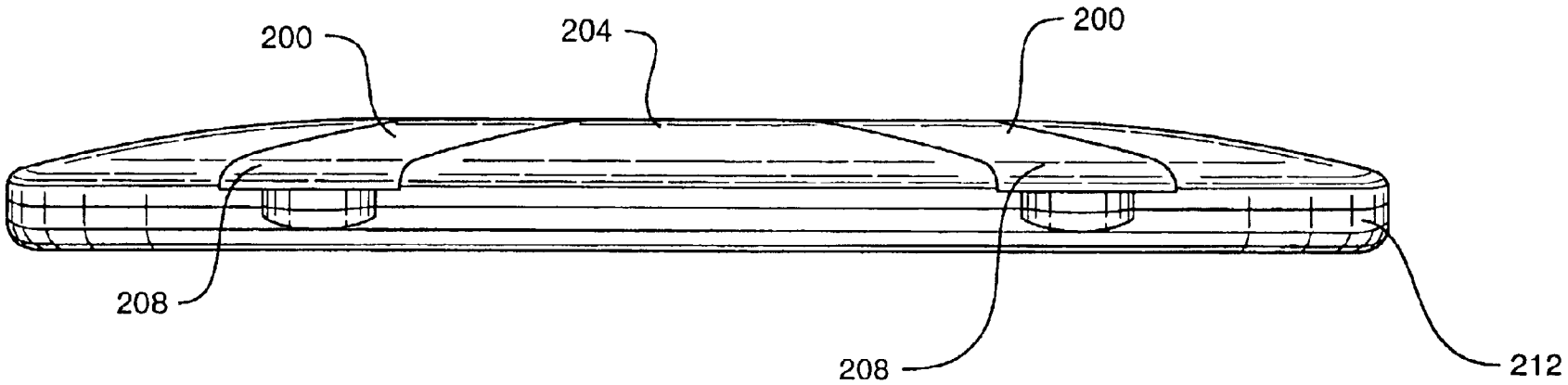

FIG. 9 shows the dielectric frames 200 in a closed or recessed position within the base 204. FIG. 10 is a side view of the base 204, wherein the dielectric frames 200 are again shown in the stored position. Note the low profile offered by an antenna constructed according to the teachings of the present invention, especially suitable for portable communications equipment. The dielectric frames 200 and their associated radial wings 126 and the dielectric frame 216 and its associated center element 130 are easily deployed to provide advantageous directional characteristics and a large electrical antenna aperture for the communications device.

Figure 11:
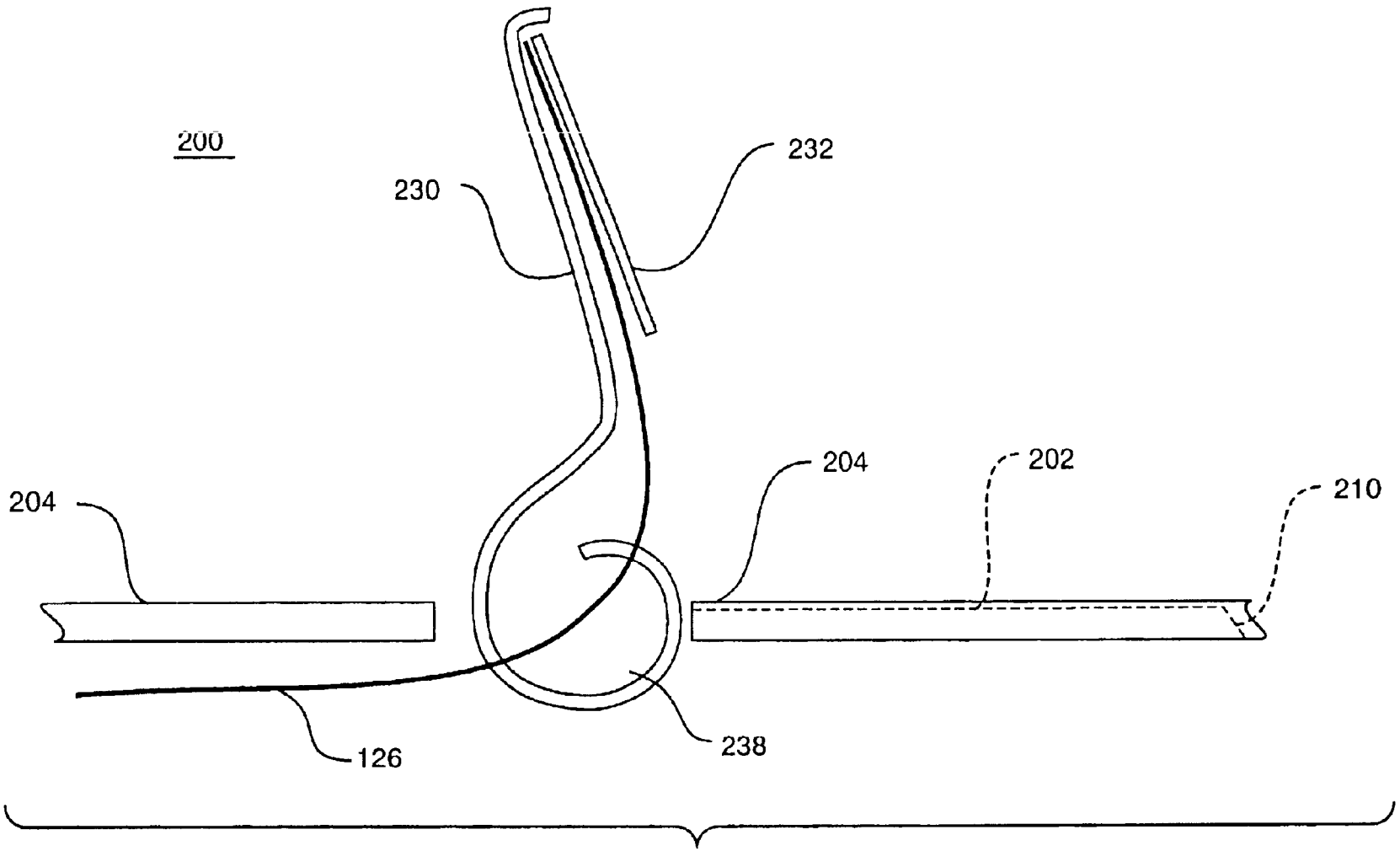
FIG. 11 illustrates the mechanism for integrating the radial wings of FIG. 2 into the enclosure FIG. 8.

FIG. 11 illustrates a dielectric frame 200, which includes a top outer cover 230 and a lower captivation cover 232. The radial wing 126 extends through an opening in the lower portion of the dielectric frame 200 and extends upwardly adjacent the top outer cover 230. Once the radial wing 126 is in place, the lower captivation cover 232 is attached to the top outer cover 230 by, for example, an adhesive, a plastic snap or an ultrasonic welding process. Although not shown in FIG. 11, the lower captivation cover 232 in one embodiment includes a boss for mating with a hole in the top outer cover 230. The boss further protrudes through a hole in the radial wing 126, holding the radial wing 126 in a fixed position with respect to the top outer cover 230 and the lower captivation cover 232. The dielectric frame 200 rotates downwardly to fit within the recess 202, which is also illustrated in FIG. 8. This rotational movement occurs about a pivot point placed within the area shown generally by reference character 238. Those skilled in the art recognize that there are several pivot mechanisms that can be employed in the present invention. One such pivot technique utilizes a plastic rod or axle placed within the area 238 and mating with receiving holes in the base 204. The center element 127 is fitted within the dielectric frame 216 in a similar fashion.

Figure 12A:
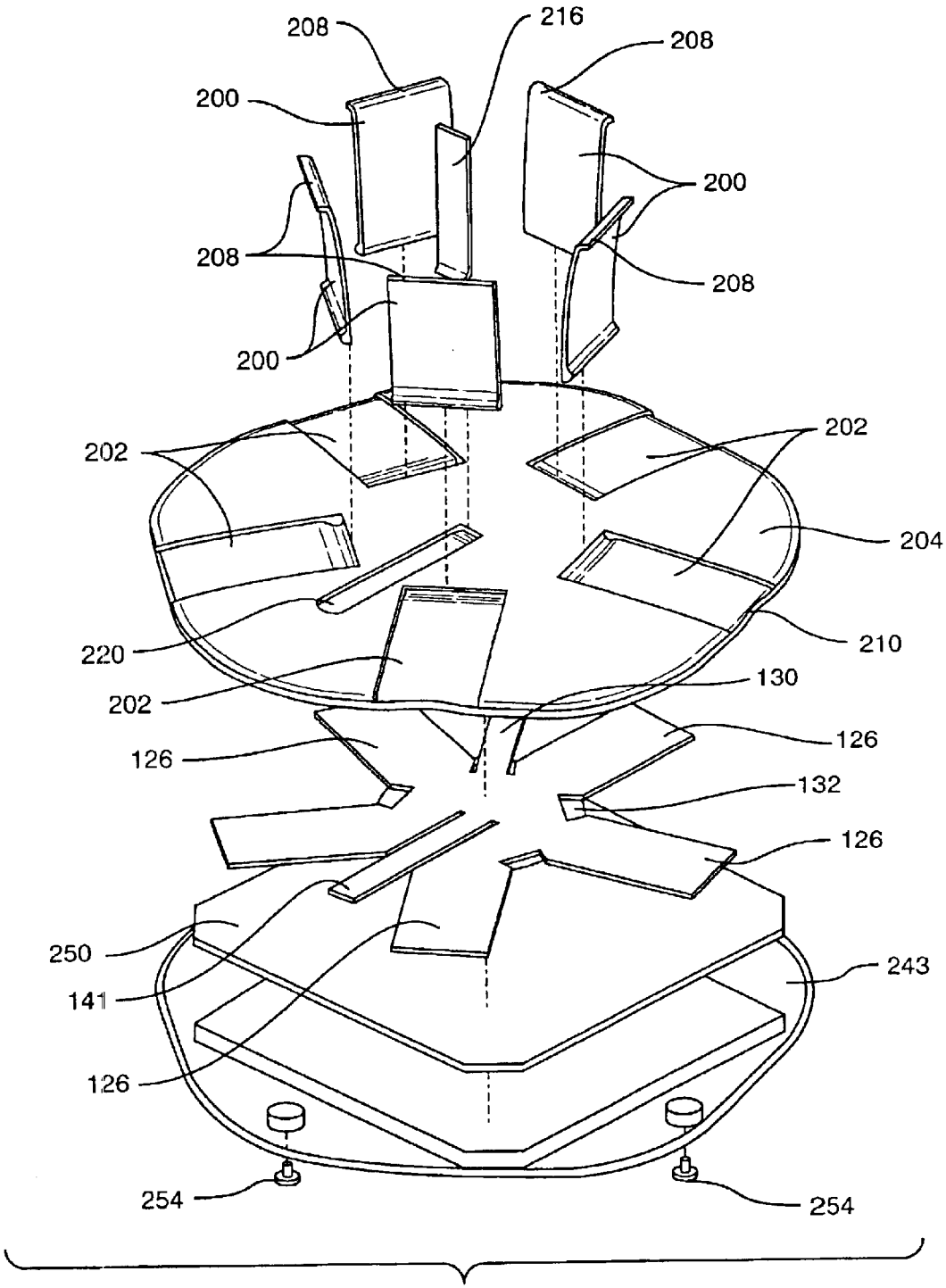
FIG. 12A is an exploded view of the enclosures of FIGS. 8, 9 and 10.

FIG. 12A is an exploded view of the housing 198 of FIG. 8, including the various elements of the present invention as discussed above. The dielectric substrate 122 is separately assembled and the radial wings passed through one or more openings in the dielectric frames 200 as shown in FIG. 11. The dielectric frames 200 are then pivotably mounted within the base 204 (as also discussed in conjunction with FIG. 11) and the base 204 is fixedly attached to a base 249 by snaps or screws 254. The FIG. 11 embodiment also includes a base plate.

Figure 12B:
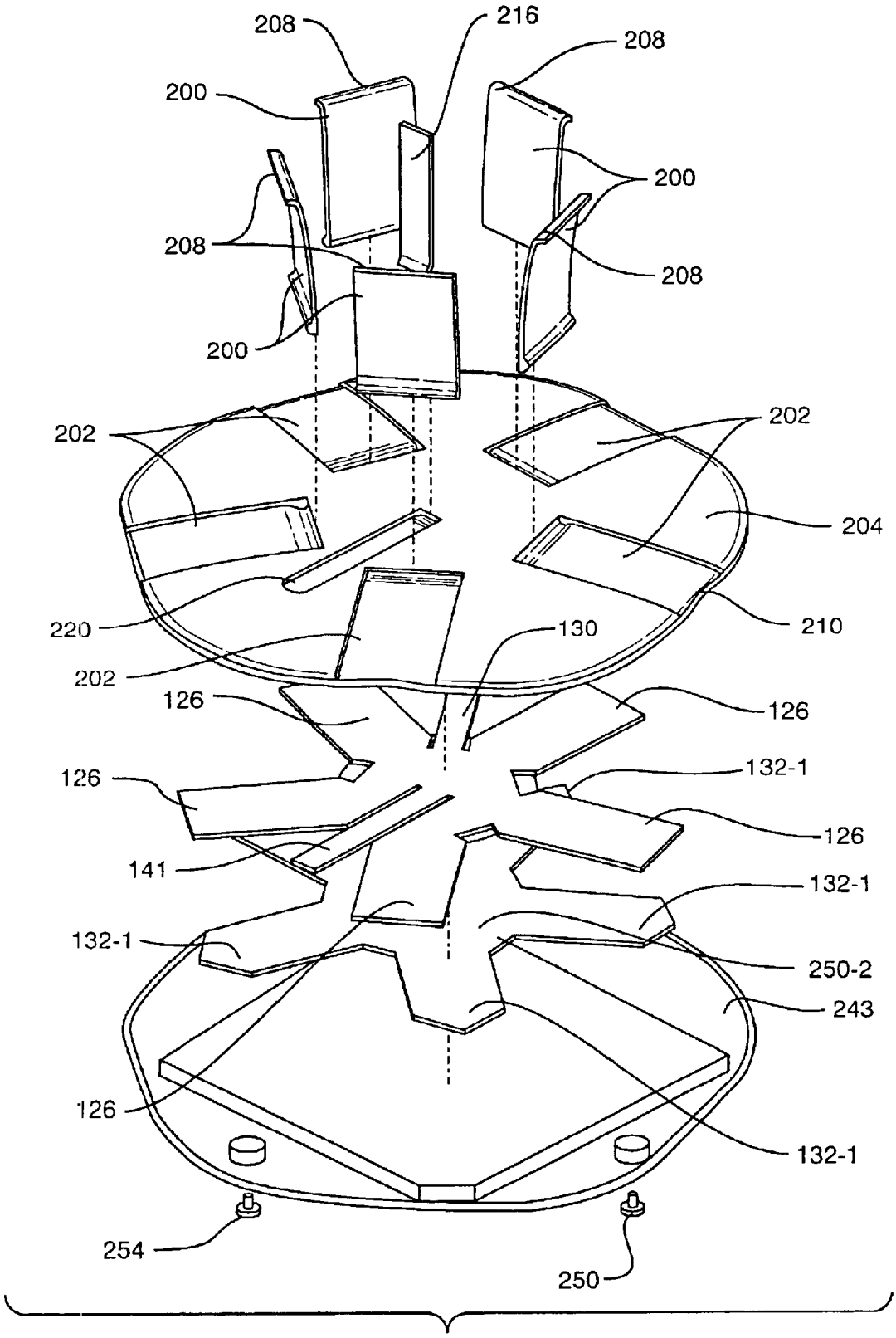
FIG. 12B illustrates an alternate arrangement of the ground plane.

FIG. 12B is a view similar to that of FIG. 12A but showing an alternate type of ground plane. Here, the ground plane is not simply a disk 132 as previously described. Rather, in this embodiment, the ground plane consists of a number of fingers 132-1 that extend outwardly from the central hub 128. The fingers are positioned radailly about the hub in approximately the same position as the radiating elements 126. In a preferred embodiment, there are the same number of fingers 132-1 as there are radial wings 126, and each fingers are of a same general shape as one of the radial wings 126.

In this embodiment, when the conductive elements 136 are monopole antennas, they are typically each coupled to or decoupled from a respective one of the ground plane fingers 132-1 to effectuate the directive and reflective properties.

Figure 13:
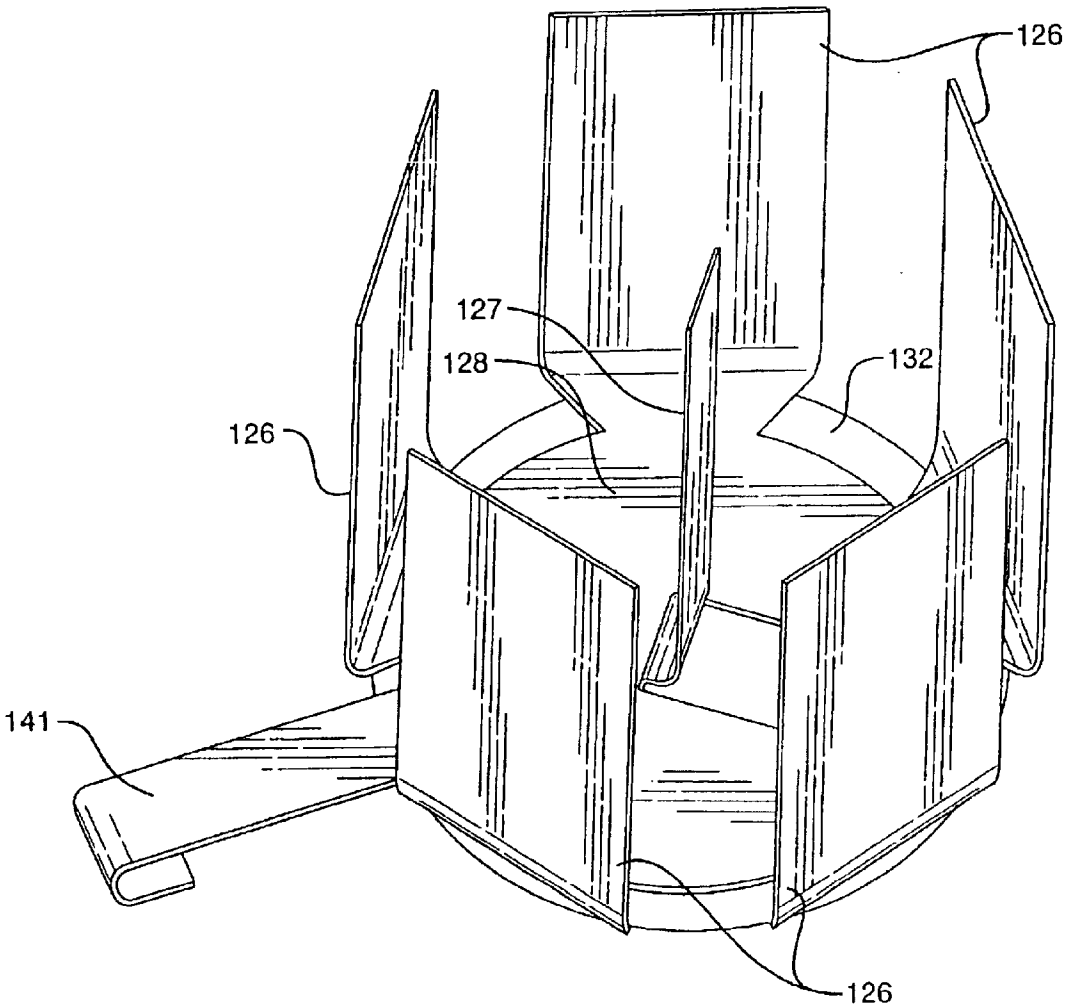
FIG. 13 illustrates an antenna constructed according to the teachings of the present invention in a deployed configuration and without the surrounding enclosure of FIG. 8.

FIG. 13 is another illustration of certain elements illustrated in FIGS. 2 and 13. However, in the FIG. 13 orientation the radial wings 126 and the center element 130 are folded upwardly into an upright or approximately vertical position for operation. Otherwise, the radial wings 126 and the center element 130 are deformable into a substantially planner stowed or folded configuration, as shown in FIG. 12.

While the invention has been described with references to a preferred embodiment, it will be understood by those skilled in the art that various changes may be made and equivalent elements may be substituted for the elements of the invention without departing from the scope thereof. The scope of the present invention further includes any combination of the elements from the various embodiments set forth herein. In addition, modifications may be made to adapt a particular situation to the teachings of the present invention without departing from the essential scope thereof. Therefore, it is intended that the invention not be limited to the particular embodiment disclosed as the best mode contemplated for carrying out this intention, but that the invention will include all other constructions falling within the scope of the appended claims.

What is claimed is:

1. An antenna array comprising:

a deformable dielectric substrate forming a plurality of antenna elements extending radially from an integral center hub, such that a deformable union is formed between the integral center hub and the plurality of antenna elements; and a ground plane formed as a plurality of fingers, a ground plane finger associated with a respective one of the antenna elements;

wherein said plurality of antenna elements are deformable substantially perpendicular to the integral center hub and otherwise configurable into a substantially planar orientation; and wherein at least one of the plurality of antenna elements is operable as an active element for receiving and sending radio frequency signals.

2. The antenna array of claim 1 wherein the dielectric substrate is homogeneous, and further wherein the dielectric substrate is thickened in the region of the deformable union.

3. The antenna array of claim 1 wherein the plurality of antenna elements comprise conductive material disposed on said dielectric substrate.

4. The antenna array of claim 1 wherein the number of ground plane fingers is the same as the number of antenna elements.

5. The antenna array of claim 1 wherein each one of the plurality of antenna elements is an active element for receiving or transmitting radio frequency signals, and wherein each one of the plurality of antenna elements is controllable to steer the antenna beam pattern for operation as a phased array antenna, by controlling the phase of the signal carried by the antenna element.

6. The antenna array of claim 5 wherein each one of the plurality of antenna elements is a monopole antenna.

7. The antenna array of claim 1 further comprising a plurality of electronic components formed on a surface of the dielectric substrate and operable to carry signals for the plurality of antenna elements.

8. The antenna array of claim 7 wherein one or more of the plurality of electronic components are disposed on one or more of the plurality of antenna elements.

9. The antenna array of claim 1 further comprising conductive traces disposed on the dielectric substrate for carrying signals for the plurality of antenna elements.

10. The antenna array of claim 1 wherein the plurality of antenna elements comprise an active element circumferentially surrounded by a plurality of passive elements, wherein the plurality of passive elements are adjustable between a first directive mode and a second reflective mode for directing or reflecting energy transmitted from or received by said active element.

11. The antenna array of claim 10 wherein the active element is formed from the deformable sheet by removing material from the integral center hub so as to create a gap on both sides of the active element and wherein the bottom edge of the active element remains affixed to the dielectric substrate, such that the active element can be deformed into a substantially vertical orientation with respect to the integral center hub.

12. The antenna array of claim 10 wherein the plurality of passive elements are responsive to an external control signal for placing the plurality of passive elements into the first directive mode or the second reflective mode.

13. The antenna array of claim 12 further comprising a switch for interconnecting each one of the plurality of passive elements to a respective one of said ground plane fingers in response to a control signal for determining the switch position, and wherein the switch position determines whether each one of the plurality of passive elements is in the first directive mode or the second reflective mode.

14. The antenna array of claim 1 wherein each one of the plurality of antenna elements includes a top conductive segment formed on the top surface of the dielectric substrate and a bottom conductive segment formed on the bottom surface of the dielectric substrate.

15. The antenna array of claim 1 wherein the ground plane is situated below the deformable sheet.

16. The antenna array of claim 15 wherein the ground plane is integral with the deformable sheet.

17. The antenna array of claim 1 wherein the antenna array is enclosed within a housing, comprising:

a base;

a like plurality of dielectric frames, wherein each one of the plurality of antenna elements is disposed within one of said plurality of dielectric frames; and a ground plane formed as a plurality of fingers, a ground plane finger associated with a respective one of the antenna elements;

wherein each one of said plurality of dielectric frames is pivotably attached to said base, such that the plurality of antenna elements are positionable substantially perpendicular to the integral center hub by rotation, about said pivotable attachment, of said plurality of dielectric frames into a substantially vertical position with respect to said base, and wherein said plurality of dielectric frames are pivotable into a position proximate said base.

18. The antenna array of claim 1 wherein the union between the integral center hub and each one of the plurality of antenna elements includes a perforated joint so as to improve the flexural characteristics of the deformable union.

19. An antenna array comprising:

a substrate having a plurality of antenna elements disposed thereon and extending radially from an integral center hub thereof, wherein each one of said plurality of antenna elements has a deformable union with the integral center hub;

a ground plane formed as a plurality of fingers, a ground plane finger associated with a respective one of the antenna elements;

a center element having a deformable union with the integral center hub at the approximate center thereof;

wherein said plurality of antenna elements and said center element are operable when deformed substantially perpendicular to the integral center hub and are otherwise configurable into a substantially planer orientation.

20. The antenna array of claim 19 wherein the center element is an active element for transmitting or receiving signals, and wherein the plurality of antenna elements are operable in a first directive state or in a second reflective state for directing or reflecting signals transmitted from or received by the center element.

21. The antenna array of claim 19 further comprising conductive paths on the substrate for providing signals to and receiving signals from the plurality of antenna elements and the center element.

22. The antenna array of claim 21 wherein the conductive paths are disposed on the top surface of the substrate.

23. The antenna array of claim 21 wherein the conductive paths are disposed on the bottom surface of the substrate.

24. The antenna array of claim 19 wherein the ground plane is oriented below the integral central hub.

25. The antenna array of claim 21 further comprising microelectronics components disposed on a surface selected from among the integral central hub, one of the plurality of antenna elements and the center element.

26. An antenna array comprising:

a center hub formed from a first dielectric substrate;

a plurality of antenna elements comprising a conductive surface formed on a second dielectric substrate and deformably attached to said center hub, such that said plurality of antenna elements are deformable into a substantially upright orientation and deformable into a substantially planer orientation; and a ground plane formed as a plurality of fingers, a ground plane finger associated with a respective one of the antenna elements;

wherein at least one of the plurality of antenna elements is operable as an active element for receiving and sending radio frequency signals.

27. The antenna array of claim 26 wherein the plurality of antenna elements are joined to the outer edge of the center hub.

28. The antenna array of claim 26 wherein the first and second dielectric substrates comprise rigid dielectric material and wherein the center hub and the plurality of antenna elements are joined by a deformable dielectric material disposed there between.

29. The antenna array of claim 26 wherein the plurality of antenna elements comprise a plurality of radial antenna elements deformably joined to the perimeter of the center hub and a center element deformably joined to the approximate center of the center hub.

30. The antenna array of claim 26 wherein the plurality of antenna elements are operable in a phased array mode to steer the antenna beam.

* * * * *